United States Patent [19]

Mathey

[11] Patent Number: 4,934,274

[45] Date of Patent: Jun. 19, 1990

[54] SELF-ERECTING MINE

[75] Inventor: Christoph Mathey, Ockenfels, Fed. Rep. of Germany

[73] Assignee: Dynamit Nobel Aktiengesellschaft, Troisdorf, Fed. Rep. of Germany

[21] Appl. No.: 202,665

[22] Filed: Jun. 6, 1988

[30] Foreign Application Priority Data

Jun. 4, 1987 [DE] Fed. Rep. of Germany ..... 3718707
Oct. 1, 1987 [DE] Fed. Rep. of Germany ..... 3733150

[51] Int. Cl.[5] ..... F42B 23/24
[52] U.S. Cl. ..... 102/401
[58] Field of Search ..... 102/401, 411, 425

[56] References Cited

U.S. PATENT DOCUMENTS 2,398,794 4/1946 Maltby ..... 102/411
3,875,862 4/1975 Fischer et al. ..... 102/425
4,391,198 7/1983 Auge ..... 102/401

FOREIGN PATENT DOCUMENTS 2305677 8/1974 Fed. Rep. of Germany ..... 102/401
2437969 2/1979 Fed. Rep. of Germany ..... 102/401
1381702 1/1975 United Kingdom ..... 102/425

*Primary Examiner*—Charles T. Jordan
*Attorney, Agent, or Firm*—Antonelli, Terry, Stout & Kraus

[57] ABSTRACT

Self-erecting mines are known in which unfoldable erecting elements are articulated to the lower end of the mine body. When the mine body has reached the ground in some position, the erecting elements are unfolded to erect the mine body. The purpose of the invention is to prevent the erected mine body from toppling over under the influence of laterally directed forces. According to the invention, the erecting elements are lockable in the unfolded state so that they cannot fold up again. As a result, the effective supporting surface of the mine body is increased.

19 Claims, 7 Drawing Sheets

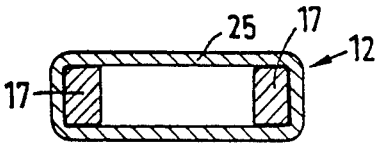
FIG.8
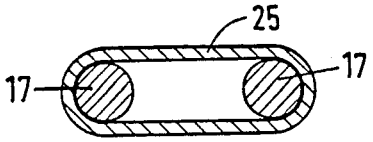
FIG.9
FIG.10
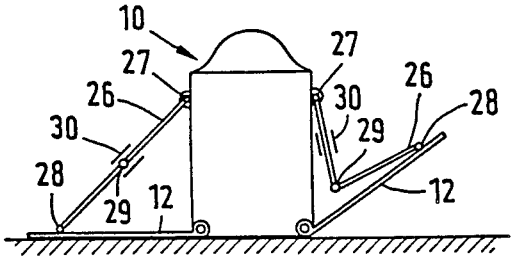
FIG.11
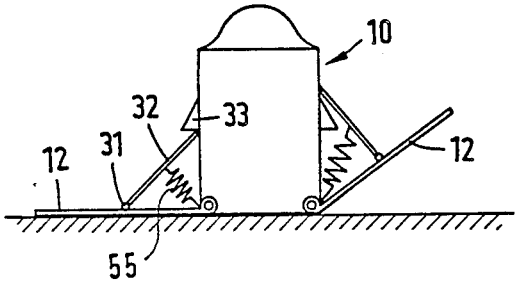
FIG.12
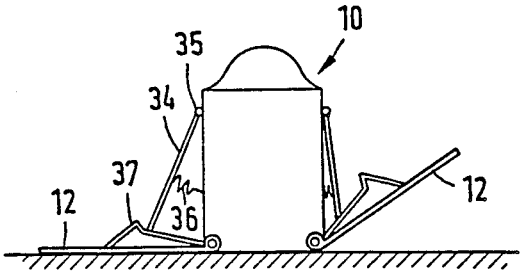
FIG.13
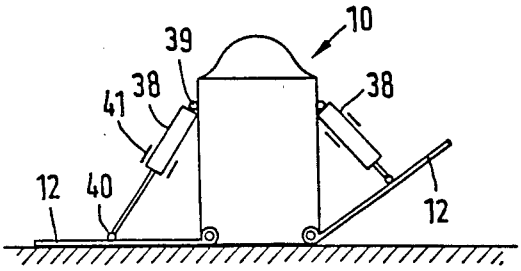

FIG.17
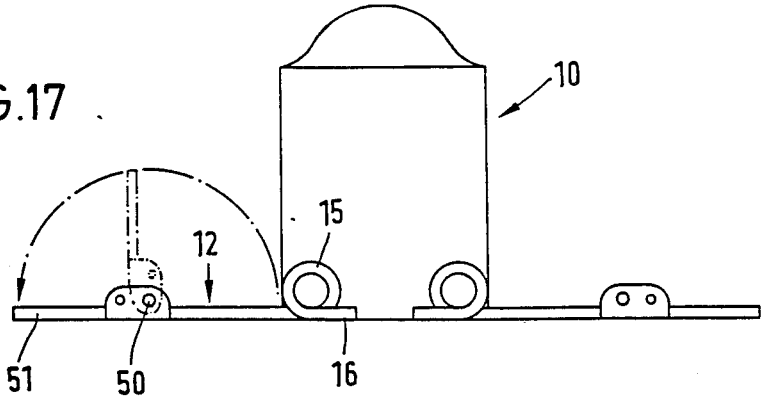
FIG.18
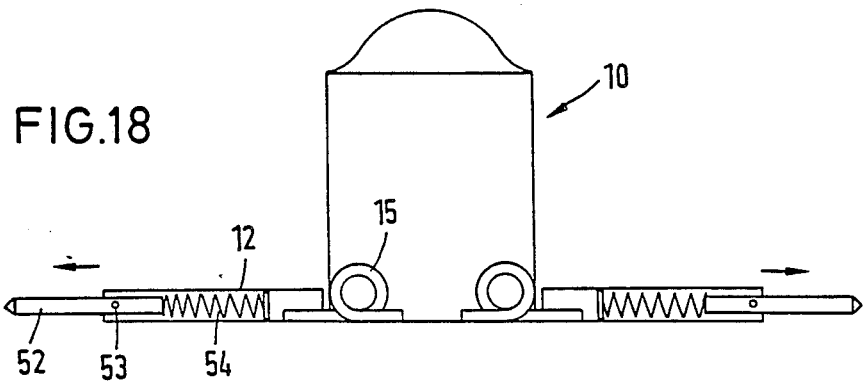
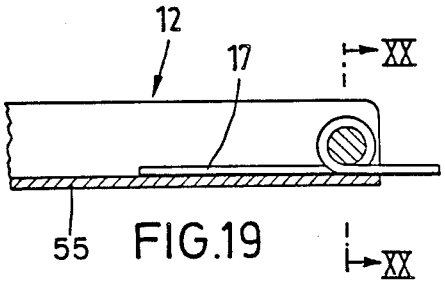
FIG.19
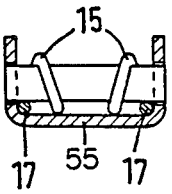
FIG.20

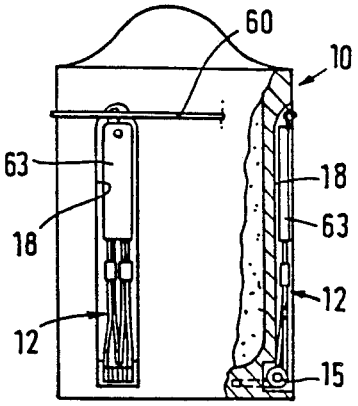
FIG. 21
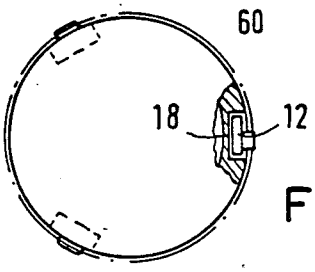
FIG. 22
FIG. 23
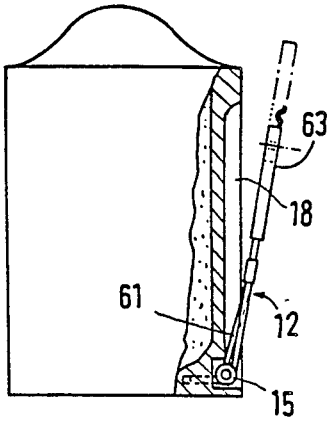
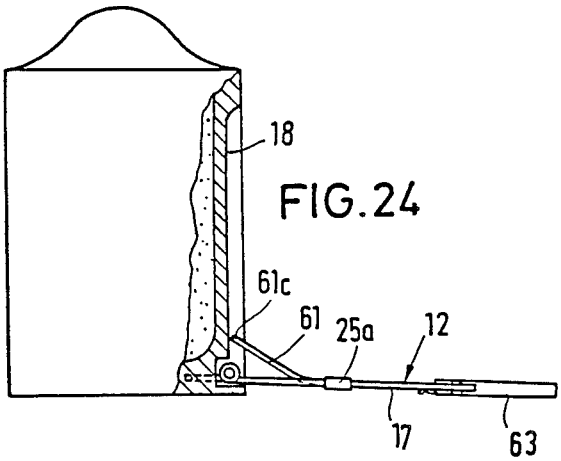
FIG. 24

XXVIII
XIX
61c
17
15
16
61b
61
12
25a
61a
63
63a
64
69
67
68
25
65a
66
65
65b

SELF-ERECTING MINE

The invention relates to a self-erecting mine having a mine body and at least one and usually at least three erecting elements that are forcibly pivotable outwardly from a lower end of the body and means for locking or retaining the erecting element or elements in the outward position away from the mine body.

Mines are known which erect themselves after being thrown or laid. These mines are provided with erecting elements mounted with articulations in the lower part of the mine body and unfold in such a fashion that they project radially from the bottom of the mine. In this manner, a mine which has fallen and lies flat on the ground is erected into its vertical operating position.

Known self-erecting mines have the disadvantage that after these mines have been erected, they can easily topple or be overturned. Although the mines are erected, there is the danger that the mines can be toppled or tilted by the force of the wind or by the action of mechanical force. The erecting elements which are unfolded by spring pressure exert a high rotary torque in the initial phase of the unfolding movement; however, this torque decreases with increasing travel in the course of unfolding, so that the erecting elements exert practically no stabilizing effect on the mine once the mine is upright.

An object of the invention is to provide a self-erecting mine of the type which is protected against toppling without significant additional expense.

The solution to this problem is provided according to the invention by providing locking means or retaining means for preventing the erecting element from returning to a folded or closed state close to the side of the mine body.

According to the invention, the erecting elements which are used to erect the mine are simultaneously used as stabilizing elements which prevent the mine from toppling. This is accomplished by the erecting elements being prevented from folding in again when they are in the unfolded state. In this manner, the erecting elements constitute outriggers which extend the bottom of the mine and essentially produce a widely projecting base for the mine. Because of this large base area, the weight of the mine, whose effect can be imagined as being concentrated at the center of gravity of the mine body, exerts a high countertorque with respect to the torques produced by lateral forces.

The locking device which locks the erecting element in the unfolded state, can have different designs which depend in each individual case on the design of the mine, its intended purpose, etc. Special embodiments of the locking device are hereinafter described in greater detail.

In the following detailed description, embodiments of the invention will be exemplified in greater detail with reference to the drawings, wherein:

FIG. 8 is a cross section through an embodiment of the erecting element;

FIG. 9 is a cross section through another embodiment of the erecting element;

FIG. 10 is a schematic diagram of a mine in which the locking device consists of a triple-jointed rod lockable in the extended position;

FIG. 11 is a schematic diagram of a mine in which the locking device consists of a diagonal strut sliding along a locking nose of the mine body;

FIG. 12 is a diagram of a mine in which the locking device has a diagonal strut articulated to the mine body, the free end of said strut supporting the erecting element when unfolded;

FIG. 13 is an embodiment with a telescoping diagonal strut;

FIG. 17 is an embodiment in which the erecting element has an unfoldable extension;

FIG. 18 is an embodiment in which the erecting element has an extension which can be slid outward telescopically;

FIG. 19 is an embodiment in which the erecting element is extended by a rigid shape;

FIG. 20 is a section taken along line XX—XX in FIG. 19;

FIG. 21 is a mine with another type of erecting element, shown in the folded state in a side elevation;

FIG. 22 is a top view of the mine in FIG. 21;

FIG. 23 shows the mine in FIGS. 21 and 22 during the unfolding of an erecting element;

FIG. 24 shows the mine in FIGS. 21–23 with the erecting element unfolded;

Figure 1:
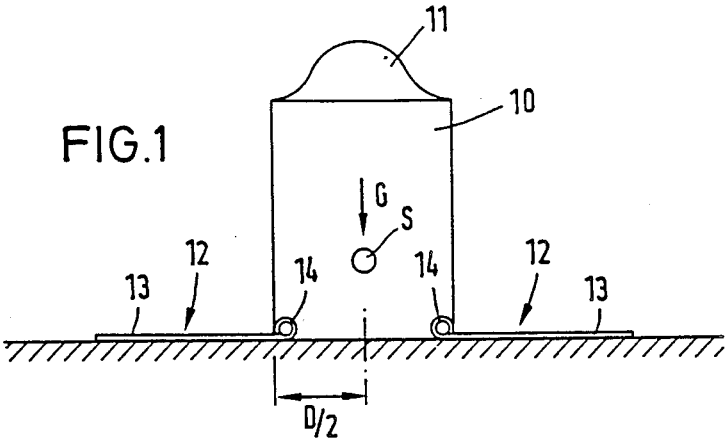
FIG. 1 is a schematic diagram of a self-erecting mine.

The mine shown in FIG. 1 has a cylindrical body 10, on whose top a dome-shaped head 11 is mounted. Four erecting elements 12 distributed around the circumference are provided on the mine body 10. Each erecting element 12 comprises two parallel leg springs, one of whose legs 13 is tensioned in the unfolding direction while the other leg is attached to the housing of mine body 10. Legs 13 are swivelable about geometric axes 14. Axes 14 are located in the vicinity of the bottom of body 10 and erecting elements 12 are initially folded up axially against body 10 where they are retained by conventional locking devices (shown and described, for example, in U.S. Pat. No. 3,875,862). When body 10 has reached the ground and come to rest, locking torques are triggered and erecting elements 12 unfold outward under spring tension so that they project radially from body 10. During this unfolding movement, body 10, regardless of what position it has assumed on the ground, is raised to the upright position. The center of gravity of body 10 is marked S and the radius of the bottom by D/2.

Figure 2:
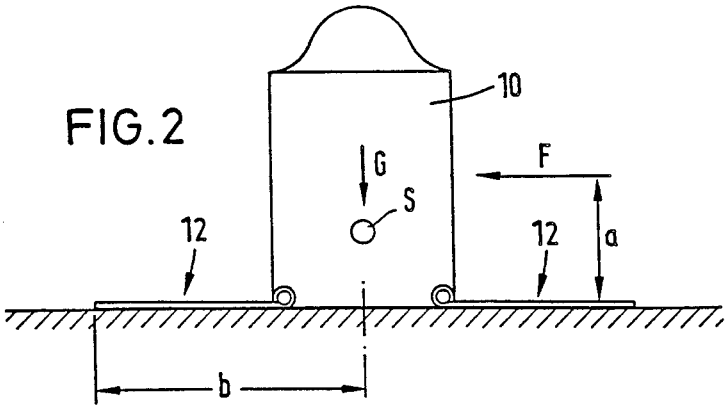
FIG. 2 is another schematic diagram which shows the relationships between the forces acting on the mine in FIG. 1.
Figure 3:
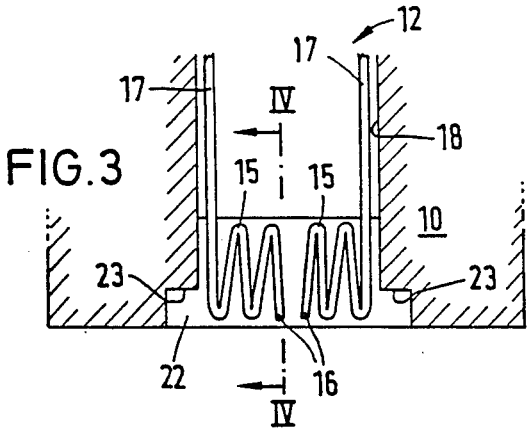
FIG. 3 is a side view, partially in section, of an erecting element provided on the mine, in the folded state.
Figure 4:
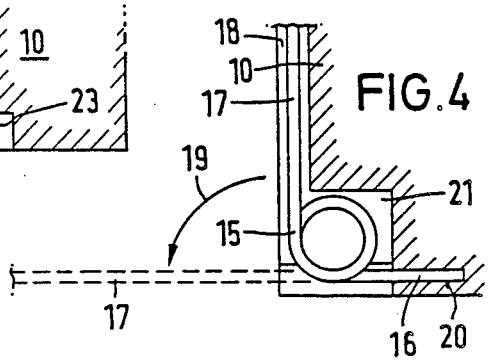
FIG. 4 is a section taken along line IV—IV in FIG. 3.
Figure 5:
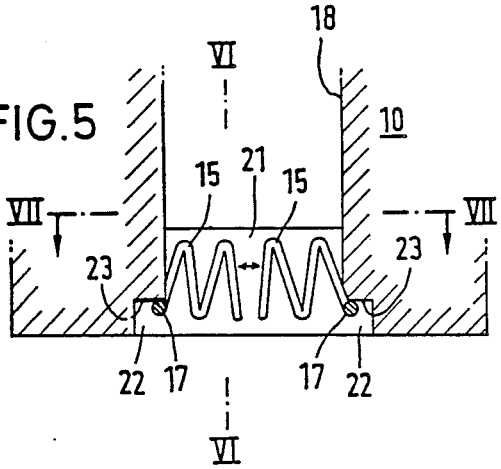
FIG. 5 is another side view as FIG. 3, but shows a state in which the erecting element has been unfolded and locked to prevent it from folding back.
Figure 6:
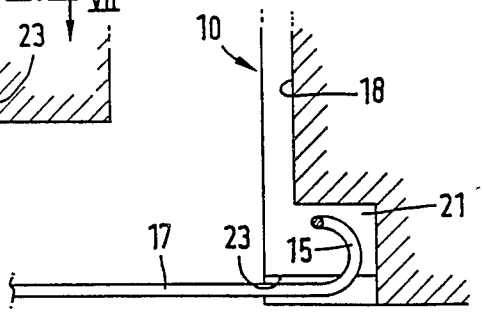
FIG. 6 is a section taken along line VI—VI in FIG. 5.
Figure 7:
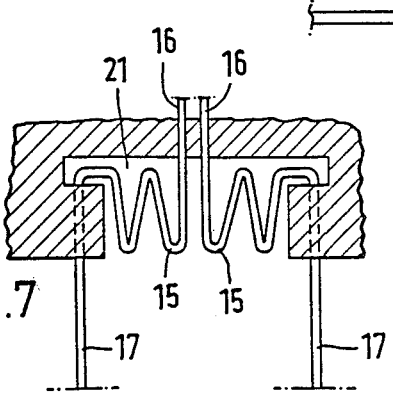
FIG. 7 is a section taken along line VII—VII in FIG. 5.

If forces act on the body parallel to the base or bottom with force component F (FIG. 2), these forces generate a torque ($F \times a$) whose magnitude is a function of height a at which force F is applied above the ground. This torque attempts to tilt the body. The moment or torque is opposed by the countertorque of the mine's own weight G and the lever arm D/2 as well as the torque composed of the force of inertia and the height of the center of gravity. In order to increase the countertorque which protects the body of the mine against tilting, erecting elements 12 are locked in the unfolded state; in other words, when they are essentially parallel to the bottom of body 10. This produces an opposing torque with a magnitude ($G \times b$) where b is the horizontal distance of the outer end of erecting element 12 from the center of gravity S of the erected body.

In the embodiment shown in FIGS. 3 to 7, the locking device which keeps erecting element 12 in the unfolded state, comprises two leg springs 15 whose middle parts are wound helically and arranged along a common axis. Mutually adjacent legs 16 of leg springs 15 are locked in mine housing 10 while legs 17, facing away from one another,, jointly form an erecting element 12. These legs 17 are mounted recessed in an axial channel 18, which extends along the outside of body 10, in the folded state. Legs 17 are pretensioned so that when they are released, they swing outward through 90°, as indicated by arrow 19 in FIG. 4 and arrange themselves parallel to bottom 20. The turn of leg springs 15 are accommodated in a recess 21 at the lower end of body 10, which forms the spring housing.

The turns of leg springs 15 are not only tensioned in the unwinding direction, but also in the axial direction. Legs 17 are therefore pressed against the side walls of channel 18. This channel 18 has at its lower end two lateral expansions 22 whose upper ends form shoulders 23. When legs 17 are completely unfolded, their ends facing the mine are pressed into expansions 22 where they lock. Erecting element 12 formed by legs 17 could only be folded back into channel 18 if legs 17 were first forced inwardly. Recesses 22 extend over the entire depth of spring housing 21 so that legs 17 each have a portion of their length laterally forced into recesses 22.

According to FIG. 8, legs 17 cf the two springs 15 which form erecting element 12 are surrounded by a clamp 25 in the shape of a ring, giving erecting element 12 a greater spring stiffness. Clamp 25 can extend over the total length of the legs 17 of the erecting element 12 or over only a portion of said length. In the embodiment shown in FIG. 8, legs 17 have rectangular cross sections, which also increases the spring stiffness even further. In the embodiment shown in FIG. 9, legs 17 have a circular cross section.

According to FIG. 10, the locking device for locking erecting element 12 in the unfolded state consists of a diagonal strut 26 made in the form of a triple-jointed strut. Diagonal strut 26 is articulated by a first joint 27 in the upper part of body 10 and by a second joint 28 in the vicinity of the outer end of erecting element 12. In the middle area of the diagonal strut is an additional joint 29 which, when the diagonal strut is in the extended position, can be locked by a spring-tensioned locking element 30. When erecting element 12 is in the folded state, the two parts of diagonal strut 26 are folded parallel to one another and recessed in body 10. After erecting element 12 has been unfolded into the operating position, diagonal strut 26 is in the extended state and, as a result of the automatic locking of middle joint 29, diagonal strut 26 and erecting element 12 are locked in this position.

According to FIG. 11, each diagonal strut 32 is connected to erecting element 12 by a joint 31. A tension spring 55 engages diagonal strut 32, said spring forcing the outer end of the diagonal strut, facing away from joint 31, against body 10. Locking noses or projections 33 are provided on body 10, with the end of diagonal strut 32 facing the mine sliding along the sloping flanks of said projections as erecting element 12 is unfolded. When the end of the diagonal strut has overrun locking projection 33, it locks beneath projection 33 against body 10, in turn locking erecting element 12 in the unfolded state against the steep flank of the locking projection. Instead of tension spring 55, strut 32 can also be designed in the form of an articulation spring (flat spring) or an additional leg spring can be provided which acts in joint 31 and attempts to rotate diagonal strut 32 in the direction of the end of erecting element 12 which faces the mine. Strut 32 itself can also be designed in the form of a leg spring, with the turns of the spring forming joint 31.

In the embodiment shown in FIG. 12, each diagonal strut 34 is fastened by a joint 35 to the upper part of body 10. A compression spring 36 attempts to swing diagonal struts 34 away from body 10. The lower end of diagonal strut 34 abuts an upper side or inner side of erecting element 12 when the latter is folded. When erecting element 12 is unfolded, the lower end of diagonal strut 34 slides along a guide piece 37 disposed on the upper surface of the erecting element. Guide piece 37 has a locking nose which prevents diagonal strut 34 from swinging outward further when erecting element 12 is in the completely unfolded state. In this situation, the angle which diagonal strut 34 forms with the portion of erecting element 12 which is closest to the mine is less than 90° so that the locking action is automatic. Instead of compression springs 36, joint springs, flat springs, or leg springs can also be provided in joint 35 o the strut itself can be designed as a flat spring or leg spring.

In the embodiment shown in FIG. 13, the diagonal struts 38 consist of telescoping rods which have one end attached by a joint 39 to the upper part of body 10 and have the other end attached by a joint 40 to the middle area of erecting element 12. In the completely extended state, the two parts of telescoping rods 38 are locked by a spring-tensioned locking element 41, so that telescoping rods 38 can no longer shorten. Telescoping rod 38 can also be designed as a piston-cylinder unit, and the unfolding of erecting element 12 can be produced by a pressure medium or a spring.

In the embodiments described in which spring 55 or 36 is provided, unfolding of erecting element 13 can be produced simultaneously by the force of these springs.

Figure 14:
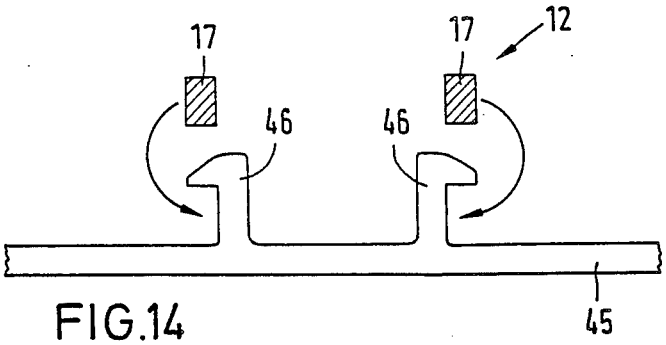
FIG. 14 is an embodiment in which the locking device consists of locking hooks provided on the bottom of the mine.
Figure 15:
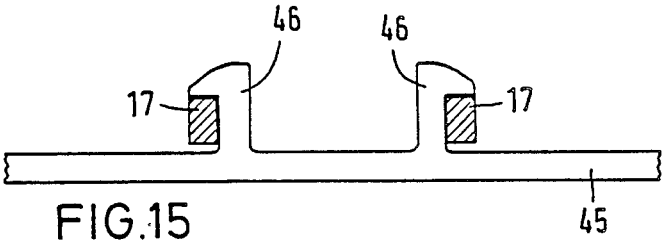
FIG. 15 shows the locking state of the embodiment shown in FIG. 14.

FIGS. 14 and 15 show another embodiment of a locking device. Here, projecting retaining hooks 46 are provided on bottom 45 of body 10, the noses of said hooks extending outward (away from one another). The parallel legs 17 of erecting element 12 are pushed beyond the outer sloping surfaces of locking hooks 46 as they unfold, and engage beneath the noses of the locking hooks above baseplate 45 (FIG. 15). In this manner, erecting element 12 is locked in the unfolded state by locking hooks 46.

Figure 16:
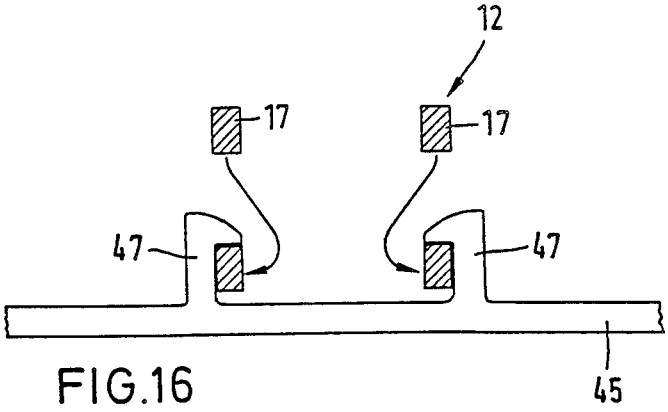
FIG. 16 shows another embodiment with locking hooks.

FIG. 16 shows an embodiment similar to those in FIGS. 14 and 15. According to FIG. 16, the noses of locking hooks 47 face one another. Legs 17 of erecting element 12 slide over these noses and are locked against the inner surfaces of locking hooks 47 which face one another.

In the embodiments shown in FIGS. 14 to 16, locking hooks 47 can either be designed so that they are under spring tension, or the elastic properties of legs 17 can be utilized to cause legs 17 to snap over rigid locking hooks 46 and 47.

The effectiveness of the locked erecting elements against forces directed laterally against the mines is improved even further if the erecting element is extended during or after unfolding. Such an extension is produced in FIG. 17 by an extension 51 provided at the outer end of erecting element 12 and foldable around joint 50. With erecting element 12 folded against body 10, extension 51 is folded by the action of a drive, for example, a spring drive, against the side of erecting element 12 which faces the body of the mine. After the erecting element is unfolded, extension 51 folds outward through 180° around joint 50, so that it lies in a common plane with erecting element 12 and extends the latter outward. Extension 51 can likewise be locked in the end position by a locking mechanism in order to prevent it from folding back.

While the length of erecting element 12 in the embodiments shown in FIGS. 1–13 can correspond at most to the height of body 10, the effective length of erecting element 12 together with extension 51 in the embodiment shown in FIG. 17 is greater than the height of the body of the mine.

In the embodiment shown in FIG. 18, erecting element 12 consists of a telescoping tube in which extension 52 is disposed in a lengthwise-displaceable fashion. When erecting element 12 is folded, extension 52 is in the fully retracted state, with the rod-shaped extension 52 being held in place by a lock located, for example, on the side of the mine. With erecting element 12 unfolded, this lock is released and extension 52 is pushed out in the lengthwise direction from erecting element 12 by springs 54, a pyrotechnic charge, or an electrical or hydraulic driving element. In the end position, extension 52 can then be locked, if necessary, by lock 53.

According to FIGS. 19 and 20, erecting element 12 comprises a bending-resistant rod 55, permanently attached to legs 17 of springs 15. In the present embodiment, rod 55 consists of a U-section against whose interior legs 17 are applied and which has its outer surface resting on the ground.

In the embodiment shown in FIGS. 21–29, erecting elements 12 are in principle designed in a manner similar to that shown in the embodiment in FIGS. 1–7. Each erecting element 12 consists of a U-shaped spring wire, having two essentially parallel legs 17. Helical leg springs 15 are formed at the ends of legs 17 (FIG. 25), the ends of said springs, facing one another, being designed as legs 16 which are attached permanently to body 10. Erecting element 12 is pivotable outward around the common axis of leg springs 15.

In FIGS. 21 and 22, erecting elements 12 are recessed in vertical channels 18 of body 10, with leg springs 15 being located at the lower end of the mine body, and likewise recessed. The upper ends of erecting elements 12 are held together by a retaining wire 60 wrapped around body 10. When wire 60 is released, all of the erecting elements 12 move outward (FIG. 23) so that, as shown in FIG. 24, they rest on the ground aligned parallel to the bottom of the mine.

A diagonal strut 61 is fastened between the two legs 17 of erecting element 12, said strut consisting of spring wire and having legs that operate in the manner of a leaf spring. The outer area **61*a* of diagonal strut 61 lies flat between legs 17 of erecting element 12, thus reinforcing the outer portion of the erecting element. Legs 17 and area 61*a* of diagonal strut 61 are surrounded by a common clamp 25*a* roughly at the center of the erecting element. The erecting element in area 61*a* of the diagonal strut can also be connected together by spot welding or in another fashion. Spring area 61*b* which abuts reinforcing area 61*a* is bent upward diagonally out of the plane of legs 17 of erecting element 12, so that its outer end 61*c* (in the relaxed state) is directed diagonally from below against the body of the mine. Bending area 61*b* in the present example is bent in the manner of a natural bending line, free of kinks, so that local stress concentrations are avoided in the tensioned spring area 61*b*. Bending area 61*b* can be bent outward additionally at its end 61*c* in order to achieve a higher point of attack of end 61*c* on the body of the mine. The area of spring-tensioned diagonal strut 61, located in the vicinity of end 61*c*, can enter the area between the turns of the two leg springs 15. In this manner, it is possible to make the erecting element relatively long with respect to the body of the mine and to provide end 61*c*** in the tensioned state in the joint area of the erecting element.

Figures 25, 26, 27, 28, 29:
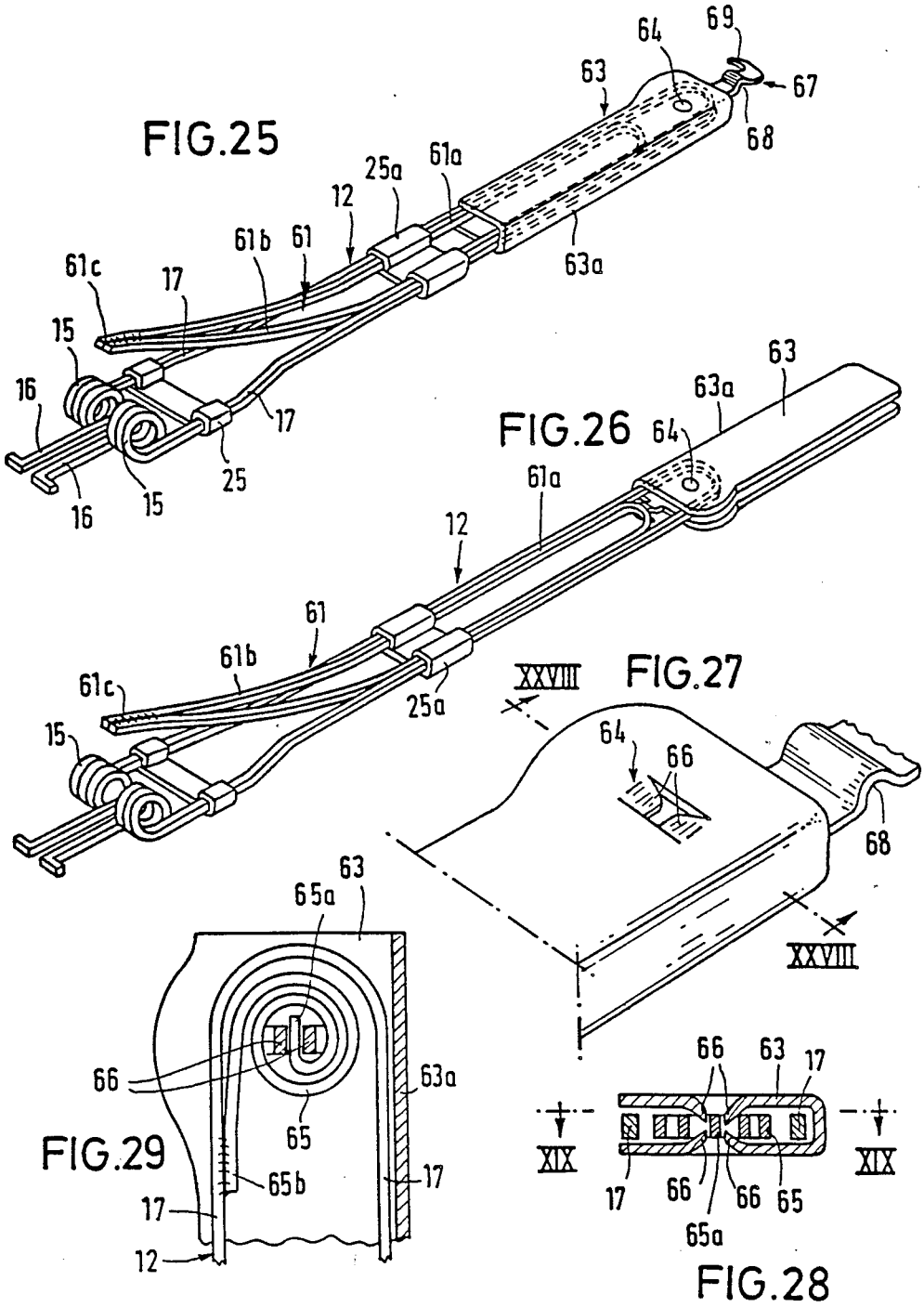
FIG. 25 is a perspective view of the erecting element of the mine shown in FIGS. 21–23 in a state in which the erecting element itself is unfolded but the extension is still folded.
FIG. 26 shows the erecting element in FIG. 25 with the extension unfolded.
FIG. 27 is a detailed view of the extension on an enlarged scale.
FIG. 28 is a section taken along line XXVIII—XXVIII in FIG. 27.
FIG. 29 is a section taken along line XIX—XIX in FIG. 28.

While erecting element 12 is folded in channel 18 against the body of the mine (FIGS. 21 and 22), spring-tensioned diagonal strut 61 presses against the bottom of channel 18, thereby coming in solid contact with the body of the mine. The erecting element is folded outward as shown in FIG. 23, thereby reaching the position shown in FIG. 24; diagonal strut 61 springs upward, causing end **61*c* to rest diagonally against the body of the mine. End 61*c* need not press directly against the body, but can also be at a certain distance from it. By friction against the mine body or by means of an additional stop, diagonal strut 61 prevents erecting element 12 from folding back. Erecting element 12, as shown in FIGS. 25 and 26, has an extension 63 in the form of a U-shaped or L-shaped body made of sheet metal, which is pivotable about an axis 64 relative to the outer end of erecting element 12. Axis 64 runs at right angles to the length of the erecting element and at right angles to its pivot axis. With erecting element 12 in the folded state, extension 63, as shown in FIG. 25, is pivoted laterally over the legs of the erecting element so that extension 63 requires nearly zero additional space. Extension 63 contains a coil spring 65 which attempts to force the extension from the inward-swung state (FIG. 25) to the outward-swung state (FIG. 26). In the inward-swung state, extension 63 is aligned with erecting element 12, but, starting at axis 64, is directed inward; in the outward-swung state, extension 63 is likewise aligned with the length of erecting element 12, but outward; in other words, as an extension of the erecting element. Extension 63 is nearly half the length of the erecting element. The fact that the inside of back 63*a* of extension 63 abuts one of the legs 17** of the erecting element in each end position creates stops which limit the swiveling motion of the erecting element in each direction.

In the inward-swung state (FIGS. 21 and 22), outward swiveling of extension 63 is prevented by the side walls of channel 18. When retaining wire 60 is released and erecting element 12 swings outward, extension 63 is released at the same time and can then likewise swing outward around axis 64. By the time erecting element 12 strikes the ground, extension 63 has already swung out.

Channel 18 of the mine body has only a very small amount of space available for accommodating the erecting elements. For reasons of economy of space, a spring housing is not provided for coil spring 65. Inner end **65*a* of coil spring 65 is held in place by tabs 66, which are punched out of the sheet metal of the parallel surfaces of extension 63 to form axis 64, and are bent in and around into the interior of the extension. In this manner, the coil springs are held inside extension 63. The outer end 65*b* of coil spring 65 is fastened, for example, by welding, to one of the legs 17 of erecting element 12 as shown in FIG. 29. In this manner, extension 63, without any projecting rivet heads or the like, can be kept as narrow as possible in order to take up less space in channel 18**.

A tongue 67 projects from the end of extension 25 which points upward when it is in the folded state in the mine body; in other words, in the vicinity of axis 64. This tongue 67 has a shaped area 68 through which retaining wire 60 (FIG. 21) runs. Tongue 67 is provided with a hook 69 which, in the outward-swung state, fits beneath one leg 17 of the erecting element and is locked there by a cam (not shown) in order to prevent the outward-swung extension 63 from swinging in again.

I claim:

1. A self-erecting mine with a mine body and an erecting element forcibly pivotable outwardly, mounted at a lower end of the mine body, characterized in that a locking means is provided which locks the erecting element in an unfolded state to prevent the erecting element from folding back again to a folded state and in that the erecting element is pretensioned in the direction of the pivot axis and fits beneath a shoulder which prevents the erecting element from folding up when the element is unfolded.

2. A self-erecting mine with a mine body and an erecting element forcibly pivotable outwardly, mounted at a lower end of the mine body, characterized in that a locking means is provided which locks the erecting element in an unfolded state to prevent the erecting element from folding back again to a folded state and in that the erecting element is coupled with a foldable diagonal strut which abuts the erecting element in the mine body when the erecting element is unfolded, and is thereby prevented from folding up again.

3. A mine according to claim 2, characterized in that the diagonal strut is designed as a triple-jointed rod whose middle joint is automatically locked in an extended state.

4. A mine according to claim 2, characterized in that the diagonal strut is articulated at one end to the erecting element and at its other end slides over a locking hose provided on the body, said nose preventing the diagonal strut from moving backward.

5. A mine according to claim 2, characterized in that a strut is connected by a joint at one end with the body and is pretensioned outward and in that the strut presses with its other end against the erecting element when unfolded.

6. A self-erecting mine with a mine body and an erecting element forcibly pivotable outwardly, mounted at a lower end of the mine body, characterized in that a locking means is provided which locks the erecting element in an unfolded state to prevent the erecting element from folding back again to a folded state and in that the erecting element is connected by a telescoping device with the mine body, said device being pulled apart when the erecting element is unfolded and being protected against sliding in again.

7. A self-erecting mine with a mine body and an erecting element forcibly pivotable outwardly, mounted at a lower end of the mine body, characterized in that a locking means is provided which locks the erecting element in an unfolded state to prevent the erecting element from folding back again to a folded state and the erecting element has an extension which can be swung out automatically when unfolded, said extension being protected against bending relative to the erecting element.

8. A mine according to claim 7, characterized in that the extension consists of an arm fastened to the free end of the erecting element by a joint.

9. A mine according to claim 7, characterized in that the extension consists of a telescoping arm of the erecting element.

10. A self-erecting mine with a mine body and an erecting element forcibly pivotable outwardly, mounted at a lower end of the mine body, characterized in that a locking means is provided which locks the erecting element in an unfolded state to present the erecting element from folding back again to a folded state and in that the erecting element has an extension, which is pivotable around an axis extending transverse with respect to a lengthwise axis of the element, through approximately 180°.

11. A mine according to claim 10, characterized in that the extension has a body which is U-shaped in cross section, said body receiving the outer end area of the erecting element in the inward-swung position.

12. A mine according to claim 10, characterized in that the extension has a body which is L-shaped in cross section, said body receiving the outer end area of the erecting element in the inward-swung position.

13. A self-erecting mine with a mine body and an erecting element forcibly pivotable outwardly, mounted at a lower end of the mine body, characterized in that a locking means is provided which locks the erecting element in an unfolded state to prevent the erecting element from folding back again to a folded state and in that the erecting element consists of an arm, from whose plane a diagonal strut acting in the manner of a leaf spring projects diagonally, and in that a free end of the diagonal strut is tensioned against the mine body when the erecting element is folded, and is directed diagonally with respect to the mine body when the erecting element is unfolded, locking the erecting element to prevent the element from folding up again.

14. A mine according to claim 13, characterized in that the diagonal strut is shaped along a bending line in a kink-free manner.

15. A mine according to claim 13, characterized in that the erecting element has two coil springs on the mine body, said springs pretensioning legs of the erecting element in the outward direction, and in that the end of the diagonal strut is accommodated between the coil springs in the folded state.

16. A mine according to claim 10, characterized in that the extension contains a coil spring for outward swinging, the inner end of said spring being fastened to at least one stamped-out, inwardly bent tab of the extension.

17. A mine according to claim 10, characterized in that the extension has a tongue which, when the extension is folded, extends in the lengthwise direction of the erecting element and forms a latch for a retaining wire wrapped around the mine body.

18. A self-erecting mine with a mine body and an erecting element forcibly pivotable outwardly, mounted at a lower end of the mine body, characterized in that a locking means is provided which locks the erecting element in an unfolded state to prevent the erecting element from folding back again to a folded state and the erecting element has an extension which can slide out automatically when unfolded, said extension being protected against bending relative to the erecting element.

19. A self-erecting mine with a mine body and an erecting element forcibly pivotable outwardly, mounted at a lower end of the mine body, characterized in that a locking means is provided which locks the erecting element in an unfolded state to prevent the erecting element from folding back to a folded state and in that the locking means is located within the lower end of the mine body.

* * * * *